US006531965B1

(12) United States Patent
Kaiser et al.

(10) Patent No.: US 6,531,965 B1
(45) Date of Patent: Mar. 11, 2003

(54) MODULAR OPEN SYSTEM ARCHITECTURE FOR UNATTENDED GROUND SENSORS

(75) Inventors: Stephen G. Kaiser, Hoffman Estates, IL (US); Mark D. Hischke, Algonquin, IL (US); Shannon Mary Nelson, Chicago, IL (US); Stuart J. Collar, Algonquin, IL (US); Dana Lynn Bourbonnais, Evanston, IL (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/546,824

(22) Filed: Apr. 11, 2000

(51) Int. Cl.[7] ..... G08C 19/16

(52) U.S. Cl. ..... 340/870.01; 340/870.16; 244/120; 102/513; 73/82; 73/84

(58) Field of Search ..... 340/820.01, 870.21, 340/870.16, 870.17; 73/84, 82; 102/513; 244/120

(56) References Cited

U.S. PATENT DOCUMENTS

| | | | | | |
|---|---|---|---|---|---|
| 3,704,764 | A | * | 12/1972 | Henderson | 181/114 |
| 4,492,111 | A | * | 1/1985 | Kirkland | 324/323 |
| 4,630,246 | A | | 12/1986 | Fogler | |
| 4,683,474 | A | | 7/1987 | Randig | |
| 4,722,282 | A | * | 2/1988 | Synofzik et al. | 102/493 |
| 4,818,994 | A | | 4/1989 | Orth et al. | |
| 5,075,857 | A | | 12/1991 | Maresca | |
| 5,339,281 | A | | 8/1994 | Narendra et al. | |
| 5,432,546 | A | | 7/1995 | Cargill | |
| 5,554,994 | A | | 9/1996 | Schneider | |
| 5,575,438 | A | | 11/1996 | McGonigle et al. | |
| 5,621,669 | A | | 4/1997 | Bjornsson | |
| 5,662,165 | A | | 9/1997 | Tubel et al. | |
| 5,730,219 | A | | 3/1998 | Tubel et al. | |
| 5,812,068 | A | | 9/1998 | Wisler et al. | |
| 5,841,280 | A | | 11/1998 | Yu et al. | |
| 5,867,257 | A | | 2/1999 | Rice et al. | |
| 5,884,867 | A | * | 3/1999 | Tohill et al. | 206/316.1 |
| 5,904,210 | A | | 5/1999 | Stump et al. | |
| 6,006,338 | A | | 12/1999 | Longsdorf et al. | |
| 6,056,237 | A | | 5/2000 | Woodland | |
| 6,072,524 | A | * | 6/2000 | Davis et al. | 348/144 |
| 6,127,926 | A | * | 10/2000 | Dando | 340/522 |
| 6,130,642 | A | | 10/2000 | Woodall, Jr. et al. | |
| 6,164,179 | A | * | 12/2000 | Buffman | 114/316 |
| 6,260,797 | B1 | * | 7/2001 | Palmer | 102/501 |
| 6,400,647 | B1 | * | 6/2002 | Huntress | 367/136 |

* cited by examiner

*Primary Examiner*—Michael Horabik
*Assistant Examiner*—Albert K. Wong
(74) *Attorney, Agent, or Firm*—Stetina Brunda Garred & Brucker

(57) ABSTRACT

An unattended ground sensor for the monitoring of a remote area. The unattended ground sensor comprises a housing that supports a power source, a communications module, at least one sensor module and a mainframe module. Additionally, the unattended ground sensor includes a common electrical bus in electrical communication with the power source, the communications module, the at least one sensor module, and the mainframe module. The common electrical bus is operative to provide a communications pathway between the power source, the communications module, the at least one sensor, and the mainframe module. Accordingly, the mainframe module is operative to control the operation of the unattended ground sensor through the common electrical bus.

40 Claims, 4 Drawing Sheets

MODULAR OPEN SYSTEM ARCHITECTURE FOR UNATTENDED GROUND SENSORS

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to ground sensors and more particularly to an unattended ground sensor that is adaptable for a prescribed mission.

Typically, ground sensors are used in combat areas to monitor enemy activity. The sensors are unattended and self supporting such that human operation is not needed. The unattended ground sensors provide surveillance, intelligence and monitoring of areas not suitable for continuous human presence. The unattended ground sensors relay information back to the field commander typically through the use of a terrestrial radio link or satellite radio link.

The unattended ground sensors are typically designed to perform a specific mission. In this respect, an unattended ground sensor is designed for a specific function such as detecting magnetic fields, detecting chemicals in the air, or detecting seismic activity. The unattended ground sensor is designed for this specific purpose and cannot be used for any other type of sensing activity. These custom designs tend to be relatively large, costly and limited in their capabilities.

The present invention addresses the deficiencies in the prior art of unattended ground sensors by providing a ground sensor with a scalable and modular design that allows for mission specific tailoring. Further, the unattended ground sensor of the present invention provides a standard backplane architecture for electrical interconnection of various sensor modules and a unique mechanical interconnection scheme that allows for inter-changeability of the sensor modules.

BRIEF SUMMARY OF THE INVENTION

An unattended ground sensor is used for the monitoring of a remote area. The unattended ground sensor comprises a housing that supports a power source, a communications module, at least one sensor module and a mainframe module. Additionally, the unattended ground sensor includes a common electrical bus in electrical communication with the power source, the communications module, the at least one sensor module, and the mainframe module. The common electrical bus is operative to provide a communications pathway between the power source, the communications module, the at least one sensor, and the mainframe module. Accordingly, the mainframe module is operative to control the operation of the unattended ground sensor through the common electrical bus.

In accordance with the preferred embodiment of the present invention, the mainframe module includes a central processing unit in electrical communication with a sensor control unit and a communications control unit for controlling the operation of the unattended ground sensor. Typically, the power source is a battery and the communications module is a radio. The radio may be configured for a prescribed mission of the unattended ground sensor.

Additionally, the mainframe module may be programmable via software for a prescribed mission of the unattended ground sensor.

The housing is configured to be dropped from an aircraft. Accordingly, the housing may be an aerodynamic housing that includes at least one fin for stability and at least one stop plate for preventing the housing from penetrating the ground beyond a prescribed depth when the housing is dropped from an aircraft. The housing may include a counterweight disposed therein for aligning the housing in the proper orientation upon being deployed from an aircraft.

In the preferred embodiment of the present invention, the common electrical bus is configured to transfer data at a rate of up to 1.5 Mbps. In this respect, the common electrical bus may be implemented with an architecture selected from RS-232, RS-485, Universal Serial Bus (USB), IEEE-1394 (FireWire), Ethernet, $I^2C$ or IrDA. In order to communicate over the common electrical bus, a data link protocol must be selected. The data link protocol may be selected from the group consisting of Point-to-Point (PPP), HDLC; USB; Ethernet; IEEE 802.xx or IrDA. It will be recognized to those of ordinary skill in the art that the common electrical bus and corresponding data link may be any type of bus and data link that transfers data at a rate of up to 1.5 Mbps and that the above examples are not exhaustive.

According to the preferred embodiment of the present invention, the unattended ground sensor may include a plurality of sensor modules connected to the common electrical bus. In this respect, the common electrical bus will be configured to be in electrical communication with a respective one of the sensor modules. The common electrical bus may connect the sensor modules in a daisy chain, as will be recognized by those of ordinary skill in the art. The sensor modules may include a sensor such as an acoustic sensor, a seismic sensor, a magnetic sensor, a chemical sensor, a passive infrared sensor, an optical sensor, or a GPS system. The common electrical bus functions as the backplane for the sensor modules such that redundancy and efficient communication between the sensor modules and the mainframe module is effectuated.

In accordance with the preferred embodiment of the present invention, there is provided a method of monitoring a prescribed location with an unattended ground sensor having a mainframe module in electrical communication with a communications module and at least one sensor module via a common electrical bus. The method comprises deploying the unattended ground sensor at the prescribed location for monitoring. Next, the at least one sensor module is operated by the mainframe module via the common electrical bus. The at least one sensor module monitors the prescribed location in order to generate information thereabout. Finally, the information is transmitted via the communications module for receipt by a receiving station.

It will be recognized, that a plurality of sensor modules may be operated by the mainframe module such that each sensor module generates respective information which is transmitted by the communications module. The unattended ground sensor may be deployed by dropping the sensor from an aircraft. The mainframe module may be preprogrammed for a prescribed mission with software in order to operate the sensor module prior to deployment of the unattended ground sensor.

BRIEF DESCRIPTION OF THE DRAWINGS

These as well as other features of the present invention will become more apparent upon reference to the drawings wherein.

DETAILED DESCRIPTION OF THE INVENTION

Figure 1:
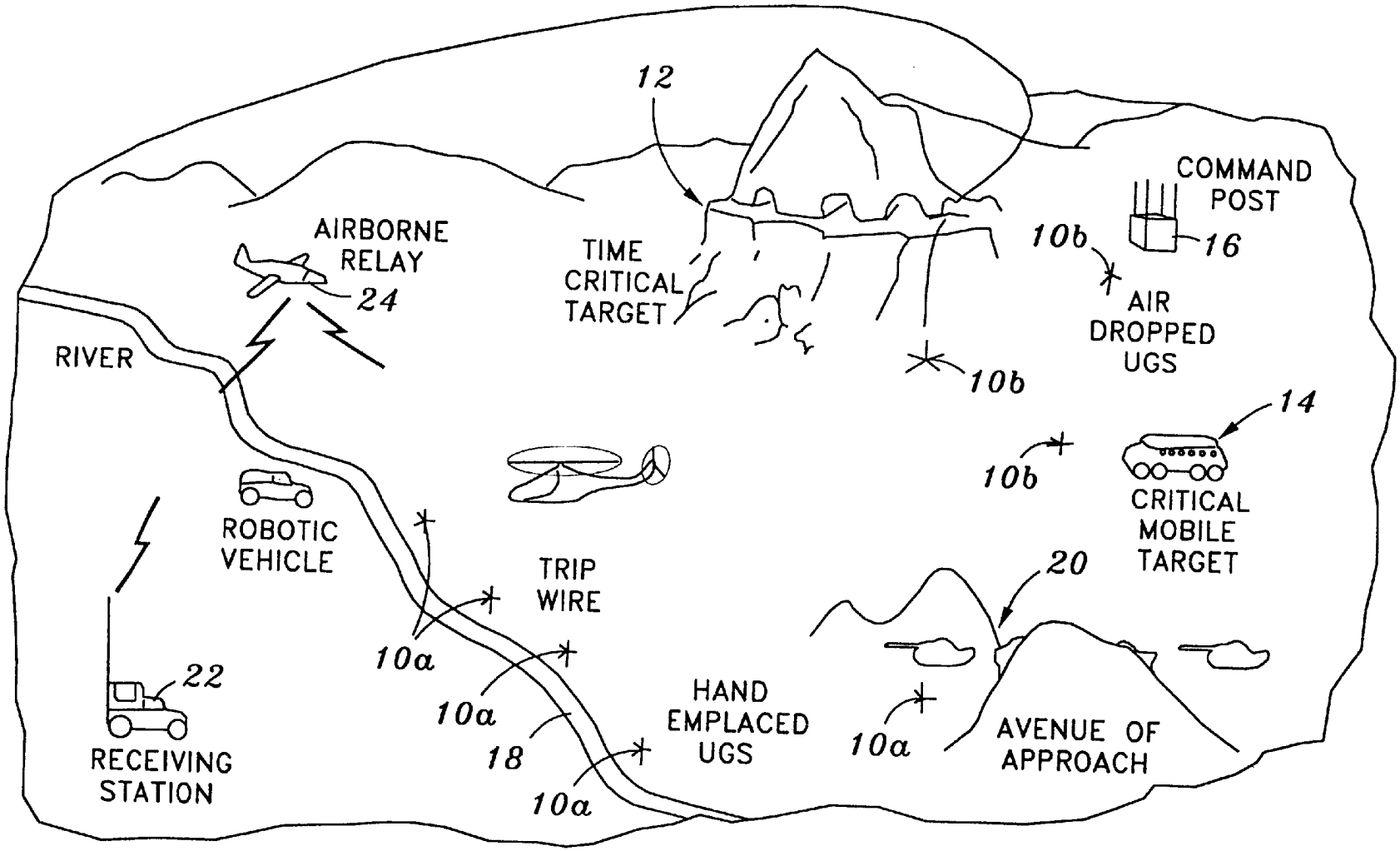
FIG. 1 is a perspective view of placement of unattended ground sensors constructed in accordance with a preferred embodiment of the present invention.

Referring now to the drawings wherein the showings are for purposes of illustrating a preferred embodiment of the present invention only, and not for purposes of limiting the same, FIG. 1 illustrates the placement and uses for unattended ground sensors 10. The unattended ground sensors 10 provide remote monitoring of battlefield movement of enemy and friendly troops. As seen in FIG. 1, hand emplaced unattended ground sensors 10*a* may be located along a river 18 to form a trip wire that remotely monitors enemy movement. Alternatively, the hand emplaced unattended ground sensor 10*a* may be located along an expected avenue of approach 20 for the enemy in order to detect them. Also, air dropped unattended ground sensors 10*b* may be dropped into an enemy location with an aircraft such that the air dropped sensors 10*b* can remotely monitor a time critical target 12, a mobile target 14, or an enemy command post 16. The unattended ground sensors 10 provide remote monitoring of the enemy without jeopardizing troops.

Each of the unattended ground sensors 10 communicates with a mobile receiving station 22 via an airborne relay 24. Alternatively, it will be recognized that each of the unattended ground sensors 10 may communicate with the mobile receiving station 22 through the use of a satellite relay or a direct radio link thereto. The unattended ground sensors 10 transmit information to the airborne relay 24 which then, in turn, relays the information to the receiving station 22. The receiving station 22 processes the information from the unattended ground sensors 10 and communicates such information to the field commander. It will be recognized to those of ordinary skill in the art that the airborne relay 24 may not be necessary if the unattended ground sensors 10 are positioned sufficiently near the receiving station 22. As such, each of the unattended ground sensors 10 communicates directly with the receiving station 22 through a direct radio link, as previously described.

Figure 2:
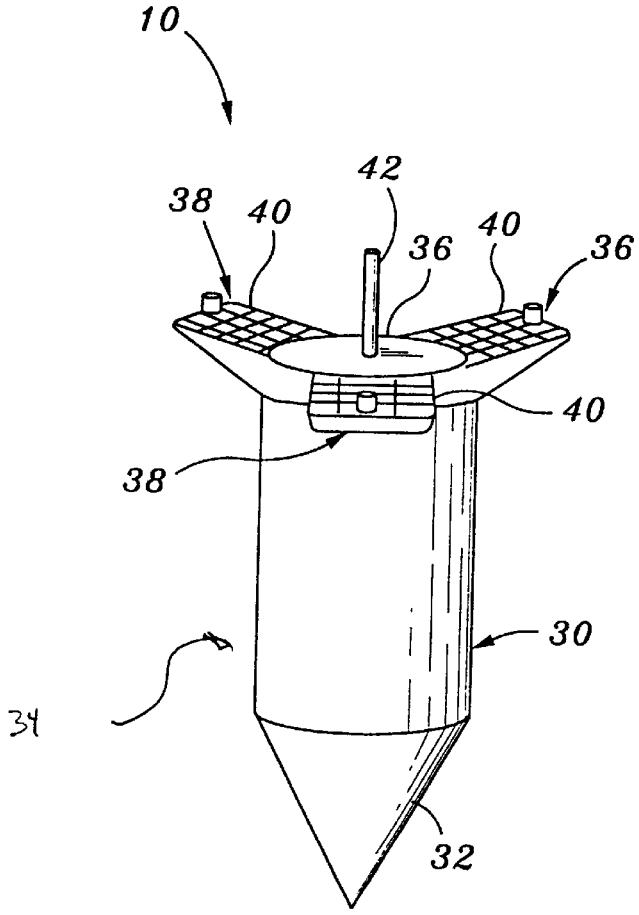
FIG. 2 is a perspective view of the unattended ground sensor constructed in accordance with the preferred embodiment of the present invention.

Referring to FIG. 2, the unattended ground sensor 10 includes a housing 30 for containing the components of the sensor 10 therein. The housing 30 has an aerodynamic shape in order to drop the unattended ground sensor 10 from an aircraft. Accordingly, the housing 30 has a cone shaped, bottom portion 32 that transitions into a cylindrical body portion 34. The bottom portion 32 and the body portion 34 are generally hollow and contain the components for the unattended ground sensor 10, as will be further explained below. Disposed on a top end 36 of the housing 30 are three aerodynamic fins 38 that provide stability for the housing during deployment from an aircraft. Each of the fins 38 is equidistantly spaced around the cylindrical top end 36 of the housing. Each of the fins 38 includes a stop plate 40 disposed on an upper surface thereof. Each stop plate 40 is a generally planar surface that extends radially from a central axis of housing 30. The stop plates 40 are operative to stop the housing 30 to a prescribed depth in the ground upon aircraft deployment, as will be further explained below. Referring to FIG. 2, an antenna 42 projects outwardly from the top end 36 of the housing 30 for communication purposes.

As previously mentioned above, the unattended ground sensor 10 can be either hand emplaced or dropped from an aircraft. If the unattended ground sensor 10 is dropped from an aircraft, then the housing 30 will be the aerodynamic housing 30 shown in FIG. 2. However, it will be recognized that if the unattended ground sensor 10 is hand emplaced, then the housing 30 will be configured differently such that fins 38 and stop plates 40 are not needed. The aerodynamic housing 30 allows the unattended ground sensor 10 to travel with the bottom portion 32 as the lowermost portion of the housing 30 upon deployment from an aircraft. Accordingly, when the housing 30 strikes the ground, the bottom portion 32 enters the ground first. The housing 30 enters the ground until the fins 38 and the stop plates 40 contact the ground. Accordingly, the stop plates 40 provide a surface area that stops the housing 30 at a prescribed depth into the ground. The top end 36, along with antenna 42 will project upwardly from the ground and be the only portion of the unattended ground sensor exposed. It will be recognized that the housing 30 must be fabricated from a material with the strength necessary to withstand impact and insertion into the ground. The housing 30 may be fabricated from a composite and/or metallic material. Additionally, the components contained within the unattended ground sensor 10 must be strengthened to withstand impact into the ground.

Figure 3:
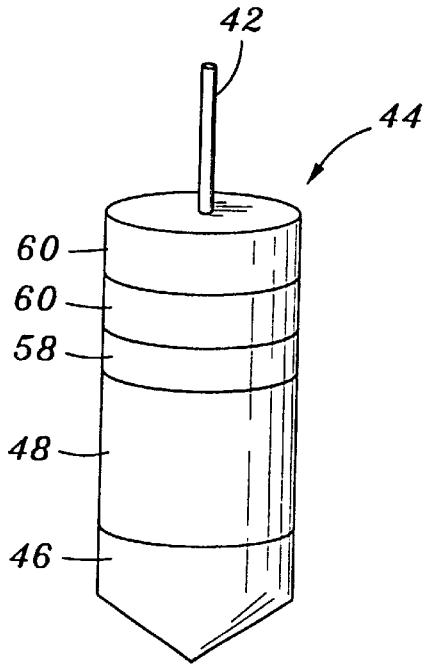
FIG. 3 is a perspective view of sensor modules for the unattended ground sensor shown in FIG. 2.

Referring to FIG. 3, a stack of sensor modules 44 that are inserted into the housing 30 are shown. The stack of sensor modules 44 is insertable into the interior of the housing 30 in order to provide surveillance operations for the unattended ground sensor 10. As will be further explained below, the stack of sensor modules 44 can be reconfigured for different missions of the ground sensor 10. Accordingly, by inserting a stack 44 for the specific mission, the unattended ground sensor 10 can be dropped into a specific area and perform the prescribed mission that the stack of sensor modules 44 is configured for.

Figure 4:
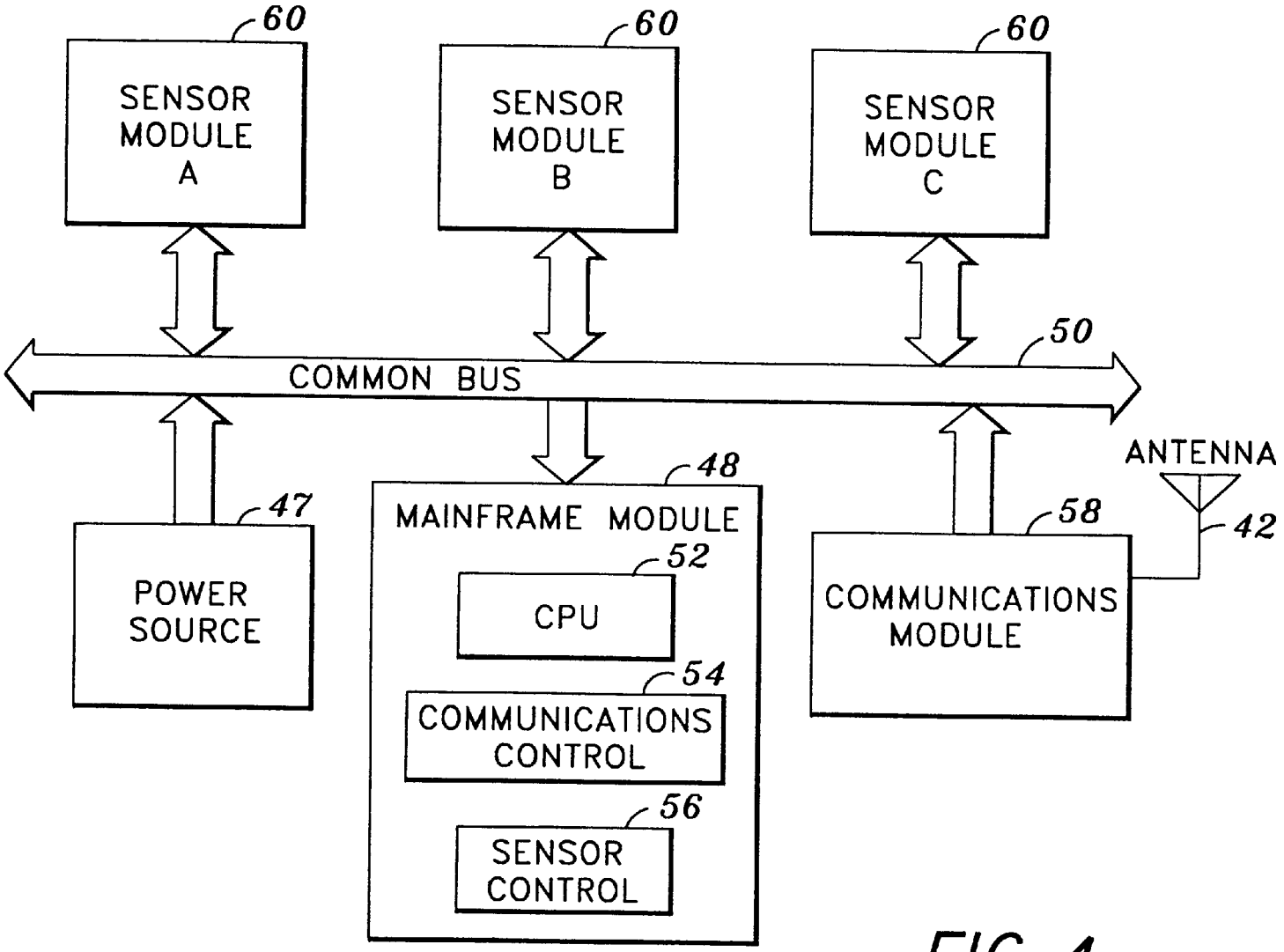
FIG. 4 is a block diagram for the unattended ground sensor shown in FIG. 2.

The stack of sensor modules 44 comprises a battery and counterweight module 46 disposed at the bottom most portion of the stack 44. In this respect, the battery and counterweight module 46 is positioned at the bottom portion 32 of the housing 30. The battery and counterweight module 46 is shaped complementary to the cone shaped bottom portion 32 of the housing 30. The battery and counterweight module 46 is therefore inserted into the cone shaped bottom portion 32. The battery and counterweight module 46 provides a power source 47 for the unattended ground sensor 10 as seen in FIG. 4. In this respect, the battery and counterweight module contains a rechargeable battery that can provide power to the unattended ground sensor 10 for the duration of its mission. The counterweight of the battery and counterweight module 46 is used to direct the bottom portion 32 of the housing 30 toward the ground during deployment of the unattended ground sensor 10 from an aircraft. Accordingly, the counterweight of the battery and counterweight module 46 will be sized and weighted to make the bottom portion 32 of the housing 30 heavier than the top end 36 thereof. The power source 47 of the battery and counterweight module 46 connects electrically to the mainframe module 48 through a common bus 50, as seen in FIG. 4. Accordingly, the battery and counterweight module will include the necessary hardware to connect to the common bus 50.

Disposed adjacent to the battery and counterweight module 46 is a mainframe module 48. The mainframe module 48 and the battery and counterweight module 46 are removably attachable to one another in order to provide modularity of the unattended ground sensor 10. It will be recognized that the battery and counterweight module 46 and the mainframe module 48 may be attached together through the use of fasteners or latches. The mainframe module 48 includes hardware that facilitates communication of the mainframe module 48 with the common bus 50.

Referring to FIG. 4, the mainframe module 48 includes a Central Processor Unit (CPU) 52, a communications control 54, and a sensor control 56 in electrical communication with each other. The CPU 52 controls the operation of the unattended ground sensor 10, as will be further explained below. The CPU 52 controls the operation of the communications control 54 and the sensor control 56. The mainframe module 48 may be programmable via software in order to configure the unattended ground sensor for the prescribed mission. In this regard, the mainframe module 48 will contain a memory storage device (i.e., RAM, ROM, etc . . . ) for the storage of a program that will control the operation of the unattended ground sensor 10. By allowing the mainframe module 48 to be controlled via software, the unattended ground sensor 10 can be reconfigured quickly and easily for any mission.

Positioned above the mainframe module 48 in the stack of sensor modules 44 is a communications module 58. The communications module 58 a radio for the specific mission of the unattended ground sensor 10. For example, the communication bandwidth of the radio may range from a few kilohertz for command and control information, to a low megahertz bandwidth for real time compressed image data. Similarly, the communication range for the radio may vary from a few hundred meters in a remote sensing application to several kilometers in a tactical surveillance application with a distributed sensor field. Alternatively, the radio may need to be configured to communicate with the airborne relay 24, as shown in FIG. 1, or satellite link (not shown). Therefore, the communications module 58 may be configured for the specific mission on hand by including the appropriate radio.

The communications module 58 is electrically connected to the bus 50. The communications module 58 therefore includes the proper hardware to effectuate communication over the common bus 50. The communications control 54 of the mainframe module 48 directs the operation of the communications module 58. Specifically, the communications control 54 transfers signals to and from the communications module 58 through the common bus 50, as required for the specific mission of the unattended ground sensor 10. The antenna 42 is also in electrical communication with the communications module 58. The antenna 42 sends and receives signals to and from the receiving station 22 or the airborne relay 24, as seen in FIG. 1. Accordingly, the antenna 42 must be positioned on the top end 36 of the housing 30 in order to effectuate efficient communication. Therefore, the antenna 42 is electrically connected to the communications module 58 through an appropriate conductor (not shown), in order to place the antenna 42 in the proper location.

Figure 5:
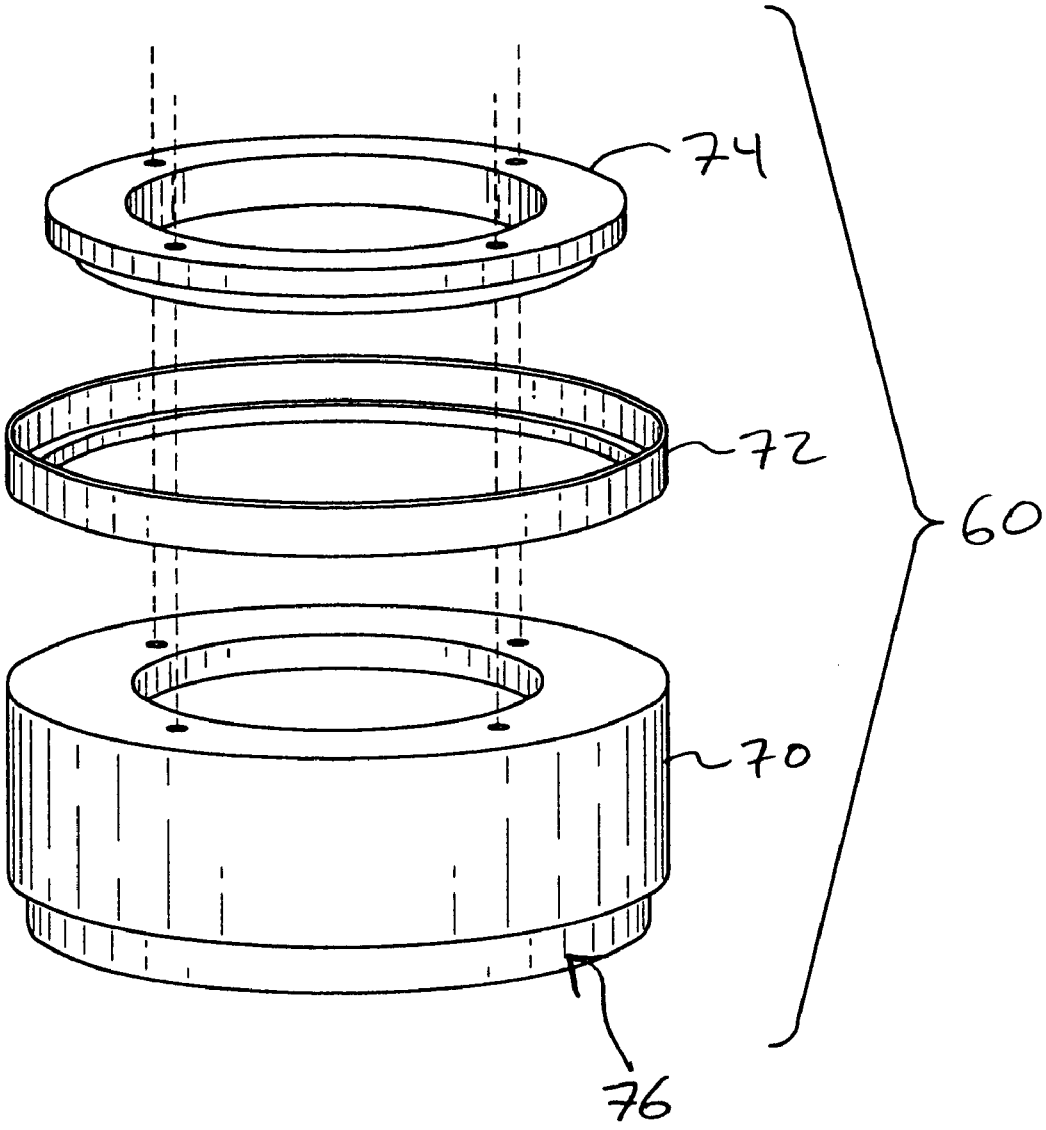
FIG. 5 is a perspective view of an individual sensor module for the unattended ground sensor shown in FIG. 3.

The stack of sensor modules 44 further includes two sensor modules 60. The sensor modules 60 are electrically connected to the common bus 50 for communication with the mainframe module 48. Each of the sensor modules 60 includes the proper hardware to effectuate communication over the common bus 50. Referring to FIG. 5, each sensor module 60 consists of three major components. Specifically, each sensor module 60 comprises a main module body 70, a threaded free spinning collar 72, and a capture ring 74. The main body module 70 includes a series of threads disposed on a lower portion 76 thereof. The threads are on an external surface of the lower portion 76 of the main module body 70 and are engageable to the threads of a free spinning collar 72 of an adjacent center module 60. The free spinning collar 72 is located between the main module body 70 and the capture ring 74. The capture ring 74, when secured to the main module body 70 allows the collar 72 to freely spin, but does not allow the collar 72 to disengage the sensor module 60. Accordingly, the capture ring 74 allows adequate (minimal) clearance to be maintained between the main module body 70 and the capture ring 74. Typically, gaskets (not shown) are positioned between the main module body 70 and the capture ring 74 in order to environmentally seal each individual sensor module 60. Additionally, the gaskets are positioned between each sensor module 60 such that as the main module body 70 is tightened against an adjacent collar 72, the gasket will be compressed therebetween.

Assembly of the stack of sensor modules 44 consists of threading the free spinning collar 72 of one module 60 onto the externally threaded portion of an adjacent main module body 70. Guide pins (not shown) on the top of the capture ring 74 align adjacent center modules 60. The guide pins will prevent spinning of center module 60 relative to an adjacent module 60 as the collar 72 is tightened. Additionally, the guide pins prevent rotation between adjacent sensor modules 60 such that electrical connections can be easily made therebetween. It will be recognized that the use of the capture ring 74 and the collar 72 may be utilized for the attachment of other modules within the stack of sensor modules 44. In this respect, the battery and counterweight 46, the mainframe module 48, the communications module 58 and the sensor modules 60 may all be attached using the above described method to form the stack of sensor modules 44.

As previously mentioned, the mainframe module 48 includes the sensor control 56 for controlling the operation of the sensor modules 60. The sensor modules 60 therefore communicate with the mainframe module 48 and the sensor control 56 over the common bus 50. The sensor modules 60 are attached to the stack of sensor modules 44 through the use of fasteners and/or latches. Accordingly, the sensor modules 60 are physically connected to one another. It will be recognized that more than two sensor modules 60 may be used with the unattended ground sensor 10. In this respect, because the unattended ground sensor 10 uses a common bus 50, it is possible to simply plug in different sensor modules 60 for varying missions. Accordingly, the size of the housing 30 can determine the number of sensor modules 60 that can be placed therein.

The sensor modules 60 provide surveillance capabilities for the unattended ground sensor 10. In this respect each of the sensor modules 60 is configured for a specific purpose. This allows for modularity of the unattended ground sensor 10 and configurability for a prescribed mission. Any combination of sensor modules 60 can be employed based on the specific mission. Each sensor module 60 has unique functionality that may make it more appropriate for a specific mission than another sensor module 60.

For example a sensor module 60 may be an acoustic sensor that listens to the environment. The acoustic sensor may have a variable number of microphones that can detect, classify, locate, and track the sounds heard thereby. The size and number of microphones can affect the size and power requirements of the acoustic sensor. Alternatively, a single microphone can be used that can only detect and classify the sound heard thereby.

Another sensor that may be used in the sensor module 60 is a seismic sensor. The seismic sensor detects motion in the direction of single axis or multiple axes. The number of channels to process the seismic data will increase the size and power requirements of the seismic sensor.

A magnetic sensor may be used in the sensor module 60. The magnetic sensor detects disturbances in the earth's magnetic field created by ferrous objects (i.e., trucks, tanks, and metallic structures). The magnetic sensor sensitivity required is dependent upon the objects to be detected and their range. Magnetic sensors are available to detect disturbances in a single axis or multiple axes. The size and power requirements of the magnetic sensor increase as a function of the number of channels to process disturbance information increases and/or the sensitivity of the magnetic sensor increases.

The sensor module 60 may contain an optical sensor that is used as an imager. The optical sensor allows the battlefield commander to see the field in which the unattended ground sensor is located. The optical sensor performs data reduction of the image in order to compress the image for transmission. It will be recognized that the optical sensor may be triggered by another sensor module 60 of the unattended ground sensor. This allows an acoustic, seismic, or other type of sensor to act as a trip-wire for the optical sensor. In this respect, once another sensor module 60 detects something, then the optical sensor will be turned on to record an image.

A GPS module may also be included as a sensor module 60. The GPS module is operative to receive and process GPS signals that facilitate determination of the location of the unattended ground sensor 10. Additionally, the GPS signals provide a time reference for the GPS module and hence the unattended ground sensor 10. Accordingly, the GPS module can determine the area that the unattended ground sensor 10 is monitoring and the time that activity is occurring. This information may be transmitted to the receiving station 22.

Another sensor contemplated for the sensor module 60 is a chemical sensor that is operative to detect chemical warfare agents in the atmosphere and transmit such information. Additionally, a passive infrared (PIR) sensor may be included within a sensor module 60. The PIR sensor provides trip-wire detection of targets in its field of view by detecting a temperature difference between the target and the background. It will be recognized by those of ordinary skill in the art that different types and/or combinations of sensors may be used in the sensor module 60. For example, a single sensor module 60 may include both an optical sensor or an acoustic sensor. Additionally, two sensor modules 60 may be combined to form a single sensor. For example, two sensor modules 60 may form a single optical sensor.

In accordance with the preferred embodiment of the present invention, sensor modules that need to be exposed for sensing are placed toward the top end 36 of the housing 30. Accordingly, the acoustic, optical, passive infrared sensors may placed at the top of the stack of sensor modules 44. Microphones, cameras, imaging systems, GPS antennas and other devices required for the sensors may be positioned near the top end 36 of the housing 30 or on the fins 38 and/or stop plate 40. Additionally, the top end 36 of the housing may include an opening for the devices. Alternatively, the housing 30 may include openings along the side thereof for the sensing devices of the sensing modules 60. The sensor modules 60 that do not need to be exposed (i.e., magnetic and seismic sensors) may be placed toward the bottom of the stack of sensor modules 44. This allows the sensor's that need to be exposed to be above ground when the unattended ground sensor 10 impacts the ground. It will be recognized that the order of the modules 60 within the housing 30 may be varied according to the mission at hand. As such, many different combinations of sensor modules 60 and their respective positions within the housing 30 may be developed.

As shown above, the mainframe module 48, communications module 58 and the sensor module 60 all communicate through the common bus 50. Accordingly, the common bus 50 ties the modules together in order to provide scalability and modularity of the unattended ground sensor 10. Modules can be added or removed from the common bus 50 as required for a prescribed mission. This feature allows the flexibility of tailoring the unattended ground sensor 10 for a specific mission by including only the modules that are desired. In this respect, the common electrical bus 60 provides a backplane for the unattended ground sensor 10.

In order to provide full functionality of the modules, the architecture for the bus 50 must be able to support data at rates on the order of 1.5 Mbps (i.e., the rate that supports compressed video). Additionally, the bus architecture must be daisy-chainable or multi-drop and expandable for future growth. The bus architecture should furthermore provide redundancy or another failure recovery mechanism due to the severe vibration and shock that the unattended ground sensor may be exposed to during deployment. Furthermore, the bus architecture should be implemented with minimal power and real estate requirements due to the portable, battery powered nature of the unattended ground sensor 10.

Accordingly, several types of bus architectures (both parallel and serial) are possible. Parallel bus implementations are conceivable, but are disadvantaged due to the real estate associated with large pin count connectors. Also, system reliability tends to decrease as a function of the number of interconnects increases. Accordingly, due to the complexity of parallel bus architecture systems, serial bus implementations are preferred. Some serial bus architectures that may be used include RS-232, RS-485, USB (Universal Serial Bus), FireWire (IEEE-1394), Ethernet, $I^2C$, and IrDA. If a serial bus architecture is implemented with one of the above-mentioned architectures, then a data link protocol must be defined for use over the bus architecture. Some common protocols that may be used include Point-to-Point (PPP), HDLC, USB, Ethernet, IEEE 802.xx, and IrDA. In this regard, all of the modules connected to the bus 50 (i.e., battery and counterweight 46, mainframe module 48, communications module 58 and sensor module 60) are configured to communicate through the common bus 50 with the chosen data link protocol.

By providing a common bus architecture for the bus 50, the unattended ground sensor 10 may be reconfigured as mission requirements change. Multiple types of sensor modules 60 and/or communications modules 58 may be interchangeable on the common bus 50. Accordingly, the unattended ground sensor 10 of the present invention provides a scalable, modular design using a standard bus architecture. The unattended ground sensor 10 therefore has an open system architecture that allows for the scalability and modularity design.

It will be recognized that the unattended ground sensor 10 may be used for applications other than military. The unattended ground sensor 10 may be used to monitor wildlife, seismic activity, trespassers, etc . . . within inaccessible areas. Accordingly, the unattended ground sensor 10 maybe air-dropped into the inaccessible area for the monitoring thereof. A base camp (i.e., receiving station) may be set up in order to receive the signals from the unattended ground sensor 10. In this respect, the unattended ground sensor 10 can monitor the surrounding area without being observed, thereby permitting a natural viewing of the area which is advantageous for wildlife observance.

Additional modifications and improvements of the present invention may also be apparent to those of ordinary skill in the art. Thus, the particular combination of parts described and illustrated herein is intended to represent only a certain embodiment of the present invention, and is not intended to serve as limitations of alternative devices within the spirit and scope of the invention.

What is claimed is:

1. An unattended ground sensor, comprising:

an aerially deployable housing having bottom and top ends, the bottom end being configured to penetrate a target ground location to mitigate detection of the housing, the top end having a radially extending assembly sized and configured to expose the top end above the target ground location when the bottom end penetrates thereinto;

a power source disposed within the housing;

a communications module disposed within the housing;

at least two sensor modules mechanically engaged to each other and disposed longitudinally within the housing between the bottom and top ends thereof;

a mainframe module disposed within the housing and being operative to control the sensor modules and the communications module; and a common electrical bus in electrical communication with the power source, the communication module, the sensor modules, and the mainframe module;

wherein the common electrical bus is operative to provide a communications pathway between the power source, the communications module, the sensor modules, and the mainframe module such that the mainframe module controls the operation of the unattended ground sensor through the common electrical bus.

2. The unattended ground sensor of claim 1 wherein the mainframe module comprises:

a central processing unit;

a sensor control unit in electrical communication with the central processing unit; and a communications control unit in electrical communication with the central processing unit.

3. The unattended ground sensor of claim 1 wherein the power source is a battery.

4. The unattended ground sensor of claim 1 wherein the communications module is a radio.

5. The unattended ground sensor of claim 4 wherein the radio is configured for a prescribed mission of the unattended ground sensor.

6. The unattended ground sensor of claim 1 wherein the housing is configured to be dropped from an aircraft.

7. The unattended ground sensor of claim 6 wherein the housing is an aerodynamic housing.

8. The unattended ground sensor of claim 1 wherein the radially extending assembly includes at least one fin and a stop plate.

9. The unattended ground sensor of claim 1 further comprising a counterweight disposed within the housing.

10. The unattended ground sensor of claim 1 wherein the common electrical bus is configured to transfer data at a rate of up to 1.5 Mbps.

11. The unattended ground sensor of claim 1 wherein the common electrical bus is implemented with an architecture selected from the group consisting of:

RS-232;

RS-485;

Universal Serial Bus (USB);

IEEE-1394 (FireWire);

Ethernet;

$I^2C$; and

IrDA.

12. The unattended ground sensor of claim 11 wherein the common electrical bus is implemented with a data link protocol in order to transfer data on the common-electrical bus.

13. The unattended ground sensor of claim 12 wherein the data link protocol is selected from the group consisting of:

Point-to-Point (PPP);

HDLC;

USB;

Ethernet; and

IrDA.

14. The unattended ground sensor of claim 1 wherein the common electrical bus is configured to be in electrical communication with each of the sensor modules.

15. The unattended ground sensor of claim 14 wherein the common electrical bus is configured to connect the sensor modules in a daisy chain.

16. The unattended ground sensor of claim 1 wherein each of the sensor modules include a sensor selected from the group consisting of:

an acoustic sensor;

a seismic sensor;

a magnetic sensor;

a chemical sensor;

a passive infrared sensor;

an optical sensor; and a GPS system.

17. The unattended ground sensor of claim 1 wherein the common electrical bus is a backplane of the unattended ground sensor.

18. The unattended ground sensor of claim 1 wherein the mainframe module is programmable for a prescribed mission of the unattended ground sensor.

19. The unattended ground sensor of claim 18 wherein the mainframe module is programmable for the prescribed mission via software.

20. An unattended ground sensor, comprising:

an aerially deployable housing having bottom and top ends, the bottom end being configured to penetrate a target ground location to mitigate detection of the housing, the top end having a radially extending assembly sized and configured to expose the top end above the target ground location when the bottom end penetrates thereinto; and at least two interlocking sensor modules disposed within the housing and each including external threads engageable to an adjacent module, each of the modules having a common electrical interface providing a communications pathway therebetween wherein each of the modules is interchangeable in order to provide varying configurations for a prescribed mission of the unattended ground sensor.

21. The unattended ground sensor of claim 20 wherein each interlocking module comprises a threaded spinning collar disposed on an end of the interlocking module opposite the external threads, the spinning collar attachable to the external threads of an adjacent module.

22. An unattended ground sensor, comprising:

an aerially deployable housing having bottom and top ends, the bottom end being configured to penetrate a target ground location to mitigate detection of the housing, the top end having a radially extending assembly sized and configured to expose the top end above the target ground location when the bottom end penetrates thereinto; and at least two sensor modules interlocked to each other in a stack and disposed within the housing, each of the modules having a common electrical interface providing a communications pathway therebetween wherein each of the modules is interchangeable in order to provide varying configurations for a prescribed mission of the unattended ground sensor.

23. A method of monitoring a prescribed ground location with an unattended ground sensor as provided in claim 22, the method comprising the steps of:

a) deploying the unattended ground sensor at the prescribed ground location, the unattended ground sensor having bottom and top ends;

b) penetrating the unattended ground sensor into the ground location with the bottom end until only the top end is exposed thereabove to mitigate detection of the unattended sensor;

c) operating the sensor modules with the mainframe module via the common electrical bus, the sensor modules being mechanically engaged to each other and being disposed longitudinally within the unattended ground sensor between the bottom and top ends thereof;

d) monitoring the prescribed location with the sensor modules in order to generate information about the prescribed location; and e) transmitting the information generated by the sensor modules with the communications module.

24. The method of claim 23 wherein:

step (b) comprises operating the sensor modules with the mainframe module;

step (c) comprises monitoring the prescribed location with the sensor modules in order to generate information from respective ones of the sensor modules; and step (d) comprises transmitting the information from respective ones of the sensor modules with the communications module.

25. The method of claim 23 wherein step (a) comprises deploying the unattended ground sensor by dropping the unattended ground sensor from an aircraft.

26. The method of claim 23 wherein step (b) comprises operating the sensor modules via the common electrical bus with an architecture selected from the group consisting of:

RS-232;

RS-485;

Universal Serial Bus (USB);

IEEE-1394 (FireWire);

Ethernet;

$I^2C$; and

IrDA.

27. The method of claim 26 wherein step (b) further comprises operating the sensor module via the common electrical bus with a data link protocol selected from the group consisting of:

Point-to-Point (PPP);

HDLC;

USB;

Ethernet; and

IrDA.

28. The unattended ground sensor of claim 23 wherein step (c) comprises monitoring the prescribed location with the sensor modules each selected from the group consisting of:

an acoustic sensor;

a seismic sensor;

a magnetic sensor;

a chemical sensor;

a passive infrared sensor;

an optical sensor; and a GPS system.

29. The method of claim 23 further comprising the step of programming the mainframe module with software to operate the sensor modules prior to deploying the unattended ground sensor.

30. The method of claim 29 wherein the step of programming the mainframe module comprises programming the mainframe module for a prescribed mission of the unattended ground sensor.

31. The unattended ground sensor of claim 22 wherein each of the sensor modules include external threads engageable to an adjacent module.

32. The unattended ground sensor of claim 31 wherein each of the sensor modules comprise a threaded spinning collar disposed on an end of the module opposite the external threads, the spinning collar attachable to the external threads of an adjacent module.

33. An unattended ground sensor for mitigating detection thereof while surveying around a target ground location, the sensor comprising:

an aerially deployable housing having bottom and top ends;

at least two sensor modules mechanically engaged to each other and disposed longitudinally within the housing between the bottom and top ends thereof for surveying around the target ground location; and a radially extending assembly formed at the top end of the housing, the assembly being sized and configured to expose the top end above the target ground location when the bottom end of the housing penetrates thereinto so as to mitigate the detection of the housing.

34. The sensor of claim 33 wherein the housing is fabricated from a metallic material.

35. The sensor of claim 33 wherein the housing is an aerodynamic housing.

36. The sensor of claim 33 wherein the top end of the housing comprises an upwardly projecting antenna.

37. The sensor of claim 36 further comprising a communications module disposed within the housing, the communications module being in communication with the upwardly projecting antenna.

38. The sensor of claim 33 wherein the radially extending assembly includes a plurality of fins and stop plates.

39. The sensor of claim 38 wherein each of the stop plates have a generally planar configuration.

40. The sensor of claim 38 wherein the fins are equidistantly spaced apart from each other.

* * * * *

UNITED STATES PATENT AND TRADEMARK OFFICE

CERTIFICATE OF CORRECTION

PATENT NO. : 6,531,965 B1 
DATED : March 11, 2003
INVENTOR(S) : Stephen G. Kaiser et al.

It is certified that error appears in the above-identified patent and that said Letters Patent is hereby corrected as shown below:

Column 1,
Line 14, before the FIELD OF THE INVENTION, please insert the following:
-- STATEMENT RE: FEDERALLY SPONSORED RESEARCH/DEVELOPMENT
This invention was made with Government support under N66001-98-C-8518 awarded by the Department of the Navy. The Government has certain rights in this invention. --

Signed and Sealed this

Twenty-first Day of October, 2003

JAMES E. ROGAN
*Director of the United States Patent and Trademark Office*